US010267595B2

(12) United States Patent
Garibaldi

(10) Patent No.: US 10,267,595 B2
(45) Date of Patent: Apr. 23, 2019

(54) HOLSTER FOR A HANDGUN HAVING A TRIGGER GUARD AND A BARREL

(71) Applicant: Jérome Garibaldi, Monaco (MC)

(72) Inventor: Jérome Garibaldi, Monaco (MC)

( * ) Notice: Subject to any disclaimer, the term of this patent is extended or adjusted under 35 U.S.C. 154(b) by 109 days.

(21) Appl. No.: 15/326,491

(22) PCT Filed: Jul. 17, 2015

(86) PCT No.: PCT/EP2015/066393
§ 371 (c)(1),
(2) Date: Jan. 15, 2017

(87) PCT Pub. No.: WO2016/009039
PCT Pub. Date: Jan. 21, 2016

(65) Prior Publication Data

US 2017/0191794 A1 Jul. 6, 2017

(30) Foreign Application Priority Data

Jul. 17, 2014 (FR) ..... 14 56923

(51) Int. Cl.
*F41C 33/00* (2006.01)
*F41C 33/02* (2006.01)

(52) U.S. Cl.
CPC ..... *F41C 33/0272* (2013.01); *F41C 33/0209* (2013.01); *F41C 33/0236* (2013.01); *F41C 33/0263* (2013.01)

(58) Field of Classification Search
CPC ..... F41C 33/0272; F41C 33/0209; F41C 33/0236; F41C 33/0263
(Continued)

(56) References Cited

U.S. PATENT DOCUMENTS 5,284,281 A * 2/1994 Nichols ..... F41C 33/0227 224/193
5,511,711 A * 4/1996 Kunz ..... B60R 7/14 224/539

(Continued)

*Primary Examiner* — Brian D Nash
(74) *Attorney, Agent, or Firm* — Patshegen IP LLC; Moshe Pinchas

(57) ABSTRACT

The holster (10) for a handgun (20) having a trigger guard and a barrel (205) comprising:
- a housing (105) for the handgun comprising a top opening (110) for the passage of at least part of the handgun,
- a wedge (115) for holding the handgun in the housing,
- a first push-button (120) for positioning the wedge:
  - in a position referred to as the "retention" position, in which the wedge is positioned in the trigger guard so as to prevent the handgun from being extracted from the housing when the first button is released or
  - in a position referred to as the "released" position in which the wedge is positioned out of the trigger guard when the first button is engaged;

comprises:
- a flap (125), mounted to rotate about a hinge (130) positioned along a long side of a transverse opening (135) of the housing, said transverse opening (135) being positioned facing the barrel and forming:
  - in what is referred to as a "closed" position, a face that covers the transverse opening (135) and
  - in what is referred to as an "open" position, a guide for the sliding of the handgun toward the transverse opening and
- a second push-button (120) for opening the flap that opens the flap when the second button is engaged.

8 Claims, 3 Drawing Sheets

(58) Field of Classification Search
USPC ..... 224/244, 912
See application file for complete search history.

(56) References Cited

U.S. PATENT DOCUMENTS

| | | | | | |
|---|---|---|---|---|---|
| 5,573,157 | A * | 11/1996 | Mauriello | F41C 33/0209 | 224/244 |
| 6,320,975 | B1 * | 11/2001 | Vieweg | F41C 33/0227 | 224/193 |
| 6,641,009 | B2 * | 11/2003 | French | F41C 33/0209 | 224/193 |
| 6,732,891 | B2 * | 5/2004 | Locklear, III | F41C 33/0209 | 224/244 |
| 7,117,625 | B2 * | 10/2006 | Pikielny | F41C 33/0209 | 42/90 |
| 7,461,765 | B2 * | 12/2008 | French | F41C 33/0227 | 224/238 |
| 7,841,497 | B1 * | 11/2010 | Gregory | F41C 33/045 | 224/243 |
| 8,646,665 | B2 * | 2/2014 | Abushaev | F41C 33/0281 | 224/243 |
| 8,851,344 | B2 * | 10/2014 | Baumann | F41C 33/0263 | 224/192 |
| 9,134,093 | B2 * | 9/2015 | Yeates | F41C 33/0272 | |
| 9,175,925 | B2 * | 11/2015 | Pellegrini | F41C 33/0263 | |

* cited by examiner

HOLSTER FOR A HANDGUN HAVING A TRIGGER GUARD AND A BARREL

TECHNICAL FIELD OF THE INVENTION

The present invention relates to a holster for a handgun having a trigger guard and a barrel. It applies, in particular, to holsters for pistols or revolvers.

STATE OF THE ART

Handgun refers in a non-limiting way to a pistol or revolver. Barrel refers either to the assembly formed by the barrel and breech of a pistol, or to the barrel of a revolver. The term 'barrel' designates the long portion of the handgun comprising at least the barrel in the strict sense.

The current holster systems for handguns generally comprise:

- a means for fastening the holster to an element of clothing of a user, such as a belt for example;
- a housing for the handgun, made of a flexible or rigid material, comprising an opening positioned towards the top of the housing for the passage of the handgun; and
- a push-button whereby, when pressed by the user, a wedge inserted into the trigger guard of the handgun is retracted to allow the handgun to be extracted from the holster.

This push-button is positioned opposite the opening of the housing so as to allow the wedge to be retracted and the handgun to be grasped and extracted with one hand.

In other systems, the activation of this push-button causes a clamp, blocking the handgun at the location of the rear of the breech, to be tilted towards the front of the holster to release the handgun for extraction.

The wedge can be inserted mechanically, by means of a spring pushing the wedge, when the handgun is positioned in the housing, or manually by the user activating the insertion of the wedge mechanically.

As these holsters are generally worn on the belt, they have several drawbacks:

The first drawback is that the direction in which the push-button is pressed to retract the wedge is the opposite of the direction for extracting the handgun, which reduces the speed and dexterity with which the user performs the action of grasping and removing the gun. This loss of speed of execution, in the case of an exchange of gunfire, can have lethal consequences for the user.

The second drawback of these systems is that when the handgun is partially out of the holster, the trigger is accessible to the user while the barrel is oriented towards the user's legs. This drawback increases the risk, if the user's haste is combined with a dangerous environment, of the user firing the gun when grasping it. This shot can result in injuries for the user, especially to the legs.

The third drawback is that inserting the gun into the housing requires the user to aim for the opening of the housing, which leads to a reduction in the user's attention to his immediate environment. This reduction in attention, in the case of an arrest by a police officer, can result in a suspect escaping or a risk of injury from an attacker. In addition, this drawback can cause the gun to fall to the ground due to the user's clumsiness.

The fourth drawback is that extracting the handgun requires two movements: a first translational movement of the gun out of the holster, then a second rotational movement towards the target. These two movements increase the time for the user to aim at an attacker.

The fifth drawback is that extracting the handgun is made hard when the user is seated, in a vehicle for example, or moving, during a chase on foot for example, or when the user is in a confined space limiting the mobility of the arms.

The sixth drawback is that a shot is likely to be triggered if an object, such as a branch for example, is inserted between the trigger guard and the trigger when the gun is put away. As the movement for putting the gun away is in the same direction as the movement for activating the trigger, the object can activate the trigger when the gun is put away.

SUBJECT OF THE INVENTION

The present invention aims to remedy all or part of these drawbacks.

The present invention relates to a holster for a handgun having a trigger guard and a barrel, which comprises:

- a housing for the handgun comprising a top opening for the passage of at least part of the handgun;
- a wedge for holding the handgun in the housing;
- a first push-button for positioning the wedge:
  - in a position referred to as the "retention" position, in which the wedge is positioned in the trigger guard so as to prevent the handgun from being extracted from the housing when the first button is released; or
  - in a position referred to as the "released" position, in which the wedge is positioned out of the trigger guard when the first button is engaged;

which also comprises:

- a flap, mounted to rotate about a hinge positioned along a long side of a transverse opening of the housing, said transverse opening being positioned facing the barrel and forming:
  - in what is referred to as a "closed" position, one face that covers the transverse opening; and
  - in what is referred to as an "open" position, a guide for the sliding of the handgun toward the transverse opening; and
- a second push-button for opening the flap, which opens the flap when the second button is engaged.

Thanks to these provisions, the holster allows the handgun to be extracted or introduced via the front of the housing. This mode of extraction or introduction has several advantages:

The first advantage is that a user grasping the gun and aiming at a target is realized by a single rotational movement. The movement thus performed by the user is more ergonomic and more natural.

The second advantage is that the gun is removed from the housing more quickly since it is possible to rotate the gun in the housing when the flap is open, such a rotation being impossible in the holsters currently used. This advantage is especially pronounced in the case of urgent gunfire.

The third advantage is that replacing the handgun is easier and does not require the user to aim for an opening but rather to aim for a larger opening, on two faces of the holster, and/or the guide for sliding formed by the flap. In this way, putting the gun away is easier and faster.

The fourth advantage is that it is easier to remove the gun when the user is seated, running or in a confined space.

The fifth advantage is that an attacker's ability to restrict the removal of the gun by the user is reduced, as the gun can be removed by rotation of the user's wrist without exerting traction on the gun in order to extract this gun from the housing.

The sixth advantage is that the movements needed firstly to open the flap and secondly to extract the gun are not in opposite directions, which increases the speed with which the gun is removed by the user.

The seventh advantage is that inserting the gun in the housing is more secure, as the movement positioning the gun, when the gun passes through the transverse opening, is perpendicular to the axis of work of the trigger, which reduces the risk of injury for the user.

The eighth advantage is that the body surface exposed to shots is reduced when the holster is positioned against a belt of the user and the user is facing the danger. In effect, a user of the holster is obliged to raise a shoulder in order to extract or insert the gun into or from the holster.

The eighth advantage is that, when the gun is removed via the transverse opening, the trigger of the handgun is inaccessible to the user until the trigger guard passes the transverse opening, which greatly reduces the risk of discharging a shot due to the user's nervousness. In the cases where a shot is discharged, the barrel is not oriented towards the leg of the user.

In some embodiments, the first button and the second button are one and the same.

These embodiments make it possible to simultaneously release the wedge and open the flap, which means removing the handgun from the holster is made easier and quicker.

In some embodiments, the holster that is the subject of the present invention comprises a means for adjusting the height of at least one push-button.

The advantage of these embodiments is that they make it possible to adjust the height of the push-button to different user morphologies.

In some embodiments, the holster that is the subject of the present invention comprises a third push-button, positioned in the housing, activating this third push-button leading to the flap being placed in the closed position.

These embodiments make it possible to close the flap when the handgun is in position in the housing to make it easier to put the handgun away in the holster.

In some embodiments, the holster that is the subject of the present invention comprises a motor means to transform a longitudinal press on the first push-button into movement of the wedge in a direction generally perpendicular to the plane formed by the handgun.

The advantage of these embodiments is that they make it possible to produce the mechanism for moving the wedge at a low manufacturing cost, as the means used can be strictly mechanical.

In some embodiments, the holster that is the subject of the present invention comprises:

- a groove, along the hinge, for a rod connected to the housing;
- a means for longitudinally moving the rod when the second push-button is engaged; and
- a motor means for causing the hinge to rotate when the rod is disengaged from the groove, this rotation corresponding to the opening of the flap connected to the hinge.

The advantage of these embodiments is that they make it possible to produce the mechanism for moving the flap at a low manufacturing cost, as the means used can be strictly mechanical.

In some embodiments, the holster that is the subject of the present invention comprises a motor means to transform a longitudinal press on the second push-button into movement of the rod in a direction generally parallel to the plane formed by the handgun.

The advantage of these embodiments is that they make it possible to produce the mechanism for moving the flap at a low manufacturing cost, as the means used can be strictly mechanical.

In some embodiments, the holster that is the subject of the present invention comprises a means for locking the retention of the handgun in the housing.

These embodiments make it possible to prevent a third-party user from extracting the handgun from the holster. In addition, these embodiments make it possible for a user to stow the handgun with the holster containing this gun, and to grasp the holster and the gun in a single gesture.

In some embodiments, the shapes of the holding wedge and the housing are configured to respectively adopt the shape of a predefined handgun and the shape of the inside of the trigger guard of said handgun.

The advantage of these embodiments is that they allow the handgun to be maintained, as well as held, in the housing of the holster when the wedge is in a retention position. This maintenance is strengthened by adjusting the shape of the housing and the wedge to a predefined model of gun.

BRIEF DESCRIPTION OF THE FIGURES

Other advantages, aims and particular features of the invention will become apparent from the non-limiting description that follows of at least one particular embodiment of the holster that is the subject of the present invention, with reference to drawings included in an appendix, wherein.

DESCRIPTION OF EXAMPLES OF REALIZATION OF THE INVENTION

The present description is given as a non-limiting example.

Figure 1:
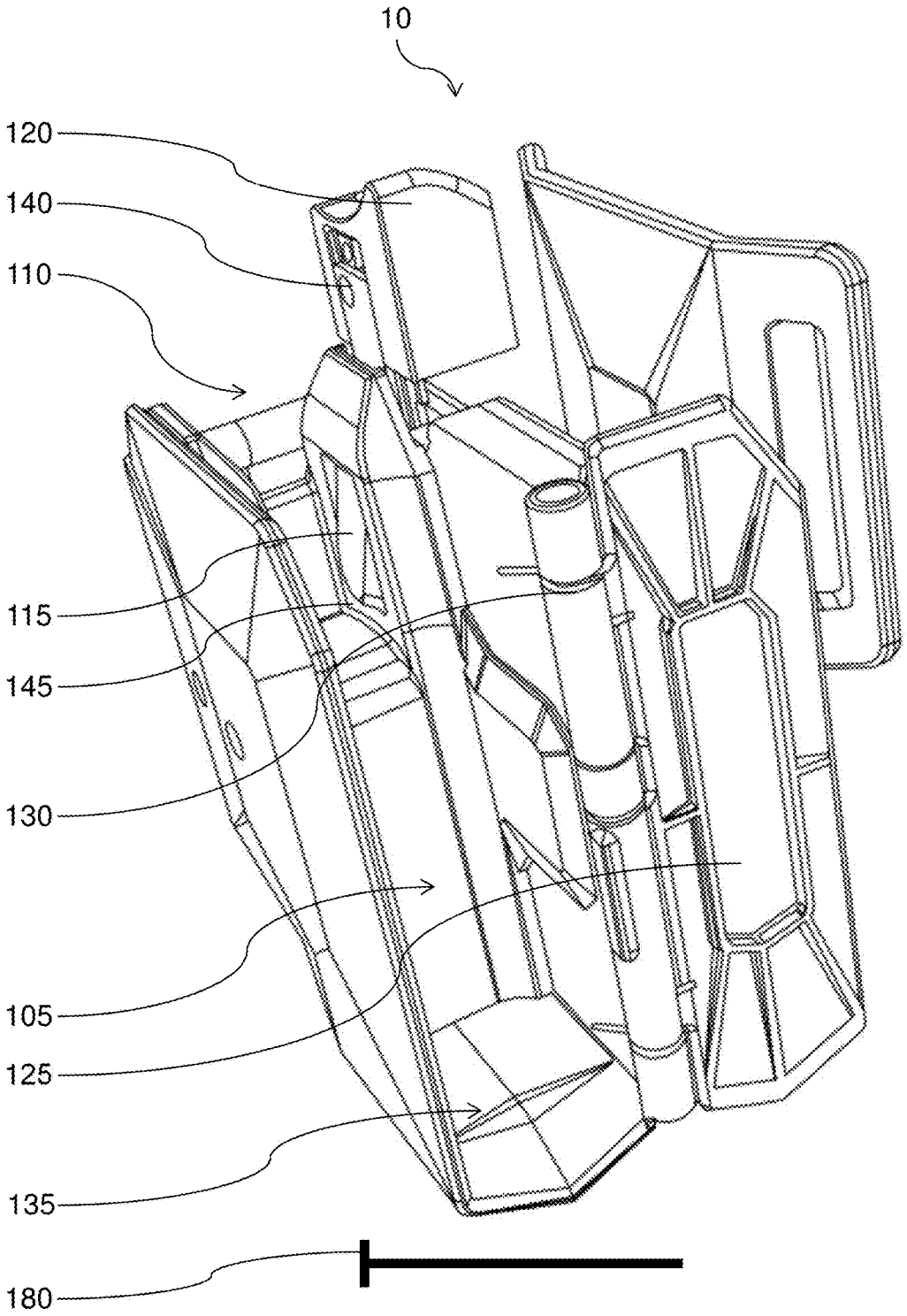
FIG. 1 represents, schematically and in perspective, a particular embodiment of the holster that is the subject of the present invention.
Figure 2:
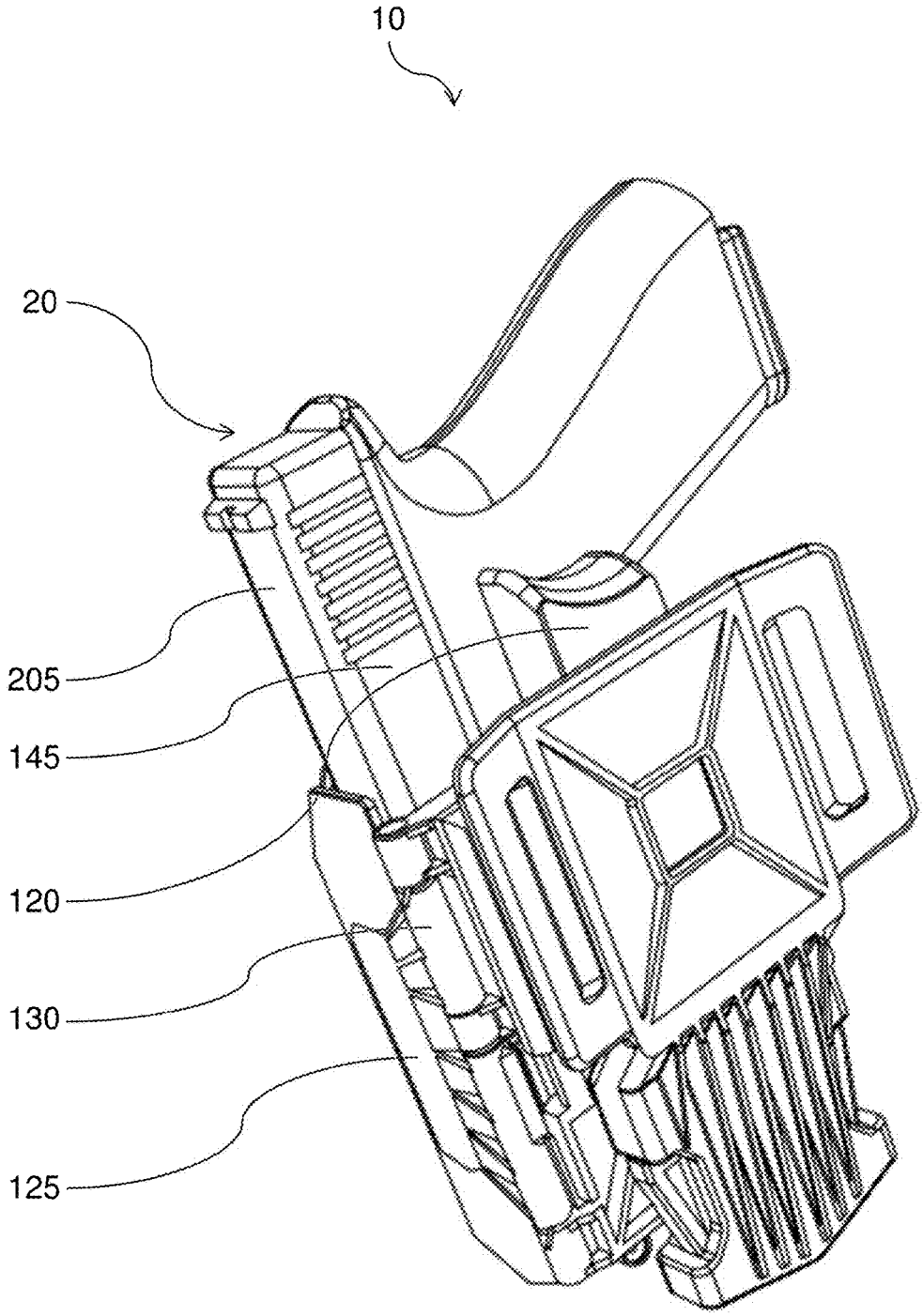
FIG. 2 represents, schematically and in perspective, a particular embodiment of the holster that is the subject of the present invention.
Figure 3:
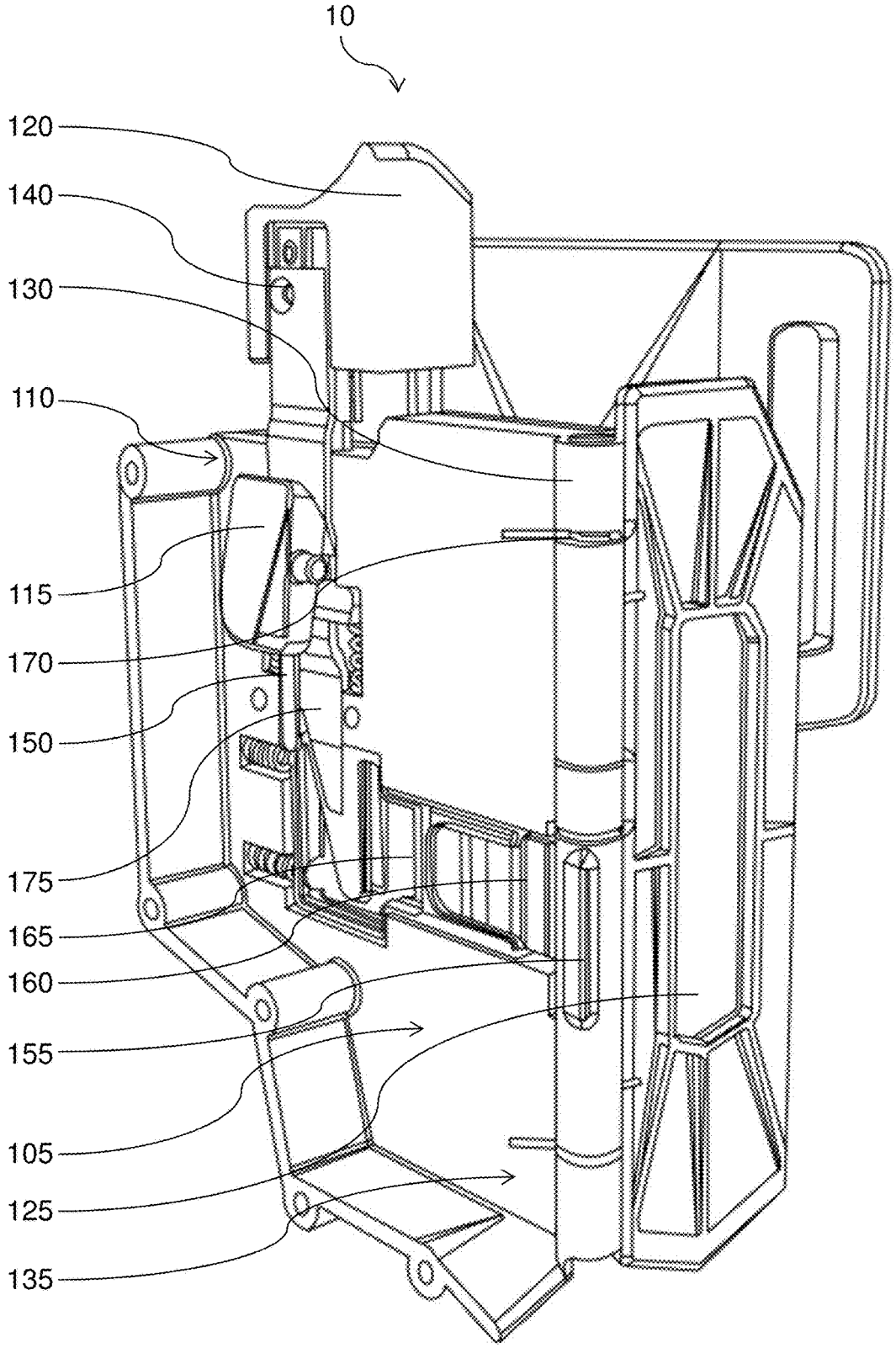
FIG. 3 represents, schematically and in partial perspective, a particular embodiment of the holster that is the subject of the present invention.

FIGS. 1 to 3, which is not to scale, a holster 10 for a handgun 20 having a trigger guard and a barrel 205, which comprises:

- a housing 105 for the handgun comprising a top opening 110 for the passage of at least part of the handgun 20;
- a wedge 115 for holding the handgun in the housing;
- a first push-button 120 for positioning the wedge 115:
  - in a position referred to as the "retention" position, in which the wedge 115 is positioned in the trigger guard so as to prevent the handgun 20 from being extracted from the housing 105 when the first button 120 is released; or
  - in a position referred to as the "released" position, in which the wedge 115 is positioned out of the trigger guard when the first button 120 is engaged;
- a flap 125, mounted to rotate about a hinge 130 positioned along a long side of a transverse opening 135 of the housing, said transverse opening 135 being positioned facing the barrel 205 and forming:
  - in what is referred to as a "closed" position, one face that covers the transverse opening 135; and in what is referred to as an "open" position, a guide for the sliding of the handgun toward the transverse opening 135; and a second push-button 120 for opening the flap 125, which opens the flap 125 when the second button 120 is engaged;

a means 140 for adjusting the height of at least one push-button 120;

a third push-button 145, positioned in the housing 105, activating this third push-button 145 leading to the flap 125 being placed in the closed position;

a motor means 150 to transform a longitudinal press on the first push-button 120 into movement of the wedge 115 in a direction generally perpendicular to the plane formed by the handgun 20;

a groove 155, along the hinge 130, for a rod 160 connected to the housing 105;

a means 165 for longitudinally moving the rod 160 when the second push-button 120 is engaged; and a motor means 170 for causing the hinge 130 to rotate when the rod 160 is disengaged from the groove 155, this rotation corresponding to the opening of the flap 125 connected to the hinge 130; and a motor means 175 to transform a longitudinal press on the second push-button 120 into movement of the rod 160 in a direction generally parallel to the plane formed by the handgun 20.

The housing 105 corresponds to the interior of a frame serving as a receptacle for the handgun 20. This empty frame comprises, for example, two complementary structural elements screwed together, these structural elements, once fixed, forming the housing 105. The housing 105 has a shape into which the handgun 20 can be fitted, this shape comprising, in particular, a long portion for the barrel 205 of the handgun 20 and a short portion, approximately perpendicular to the long portion, for the trigger guard of the handgun 20.

The housing 105 is configured to adopt the shapes of a handgun 20 available on the market. In this way, the holster 10 is adjusted according to the specifications of a plurality of handguns, and the person skilled in the art can, based on these shapes of handgun 20, produce a housing 105 whose shape is complementary to that of the handguns 20 considered.

This housing 105 comprises two openings. The first opening, referred to as the "top opening", 110 is positioned on an upper portion of the holster 10 in the axis of the long portion of the housing 105. The handgun 20 can be placed into the housing 105 through this top opening 110 by positioning the opening of the barrel 205 forward, in the long portion of the housing 105, until the handgun 20 cannot be pushed further into the housing 105.

The second opening, referred to as the "transverse opening", 135 is positioned relative to the long portion of the housing 105, ie facing the barrel 205 of the handgun 20. The hinge 130 is positioned laterally on the transverse opening 135. The hinge 130 is positioned along a long side of the transverse opening 135. The hinge 130 is on one side of the transverse opening 135 parallel to the general plane formed by the interior volume of the housing 105. The hinge 135 is positioned on a vertical axis when a user is wearing the holster 10, this vertical axis being close to the leg of the user. This transverse opening 135 is positioned facing the top portion of the barrel of the handgun. This transverse opening 135 is positioned on the long portion of the housing 105. This transverse opening 135 is perpendicular to the general plane of the handgun when the handgun is positioned in the holster. The general plane of the handgun corresponds to the general plane of the interior of the housing 105, this volume being configured to receive the handgun. Preferably, the hinge 130 is positioned on the large side of the transverse opening 135. Preferably, the hinge 130 is positioned on the side of the transverse opening 135 closest to a means for fastening to a belt of a user, this fastening means being positioned on one face of the holster 10.

The flap 125 is mounted on the hinge 130 and, in the closed position, covers the transverse opening 135. This flap 125 is, for example, a rigid flat structure made of metallic or synthetic material. When the flap 125 is in the closed position, this flap 125 forms a guide for the handgun 20 to slide toward the transverse opening 135. When the hinge 130 is positioned on the side of the transverse opening 135 closest to a means for fastening to a belt of a user, this guide for sliding is extended by the belt of the user, the handgun 20 being able to slide first on the belt, then on the flap 125, and then in the housing 105.

In some variants, when the flap 125 is open after the activation of the push-button 120, positioning of the wedge 115 in the retention position does not result in the closing of the flap 125. In these variants, the flap 125 is closed manually by the user, and the wedge 115 is positioned mechanically, by means of a spring for example, in the trigger guard of the handgun when the handgun is positioned in the housing 105. In these variants, activating the push-button 120 serves solely to release the handgun by activating the withdrawal of the wedge 115 and the opening of the flap 125.

This hinge 130 also comprises a groove 155 along the length, this groove 155 being configured to allow the fixing of a rod 160.

In some variants, the side opposite the transverse opening 135 relative to the hinge 130 comprises a means for maintaining the flap 125 in the closed position. This maintaining means is, for example, a clipping system comprising a male portion and a female portion, respectively positioned on the flap 125 and on the side of the housing opposite the hinge 130 and whose positioning can be reversed. This clipping is released when the push-button 120 is pressed.

This maintaining means can also be formed of two magnets, each magnet being positioned either on the flap 125, or on the side of the housing opposite hinge 130. The magnetization is released when the push-button 120 is pressed.

In some variants, the system maintaining the flap 125 in the closed position, which comprises the motor means 170, the rod 130 and the groove 155, is not positioned at the location of the hinge 130 but rather at the location of the extremity of the flap 125 opposite the hinge 130 relative to the transverse opening 135, the fastening then being realized on the side opposite the transverse opening 135 relative to the side of the transverse opening 135 fitted with the hinge 130.

The holster 10 comprises a motor means 170 to cause the rotation of the hinge 130 when the rod 160 is disengaged from the groove 155, this rotation corresponding to the opening of the flap 125 connected to the hinge 130. This motor means 170 is, for example, a hinge spring surrounding the hinge 130 so as to be pressed, firstly, on an inner face of the housing 105 and, secondly, on the flap 125. When the flap 125 is in the closed position, the spring is deformed. The flap 125 is maintained in the closed position by positioning the rod 160 in the groove 155. When the rod is removed from the groove 155, the hinge spring resumes its rest position and mechanically causes the hinge 130 to rotate, which has the effect of placing the flap 125 in the open position. The rod 160 is, for example, a flexible blade configured to be partially bent when a user manually closes the flap 125 until the extremity of the rod 160 enters the groove 155 and thus blocks the rotation of the hinge 130.

To move the rod 160, this rod 160 is fixed to a means for longitudinally moving 165 the rod 160. This moving means 165 is, for example, a rod holder made of a synthetic material. This moving means 165 is pushed by at least one spring in the direction of the hinge 130. This spring allows the rod 160 to be maintained in the groove 155 with no action by the user. This moving means 165 also comprises a structural element oblique relative to the axis of movement of this movement means 165. This oblique structural element is connected to a motor means 175. This motor means 175 is, for example, a blade, one extremity of which, facing the oblique structural element, is also oblique. This blade is perpendicular to the axis of movement of the moving means 165.

When the blade comes into contact with the oblique portion, the mechanical force of the blade on the oblique portion causes the moving means 165 to be moved towards the back of the housing 105, which causes the rod 160 to come out of the groove 155.

To place the flap 125 in the closed position, the user closes the flap 125 until the rod 160 is in position in the groove 155.

The first button 120 and the second button 120 are one and the same. These push-buttons 120 are, for example, positioned facing the top opening 110 so as to be, when the handgun 20 is put away, between the handgun 20 and the body of the user. In some variants, the first button 120 and the second button 120 are separate.

Pressing on the second push-button 120 causes the motor means 175 to be moved longitudinally towards the moving means 165 such that, when the user presses on the second push-button 120, the moving means 165 is moved towards the back of the housing, driving the rod 160 out of the groove 155 and causing the flap 125 to be opened.

When the pressure on the second push-button 120 is released, the springs connected to the moving means 165 drive the rod 160 towards the outside of the housing 105 and the transverse opening 135. When the rod 160 is in position outside the transverse opening 135, rotation of the hinge 130 by the user in the direction of the rod 160 causes the flap 125 to be fastened.

The first push-button 120 is connected to a motor means 150 to transform a longitudinal press on the first push-button 120 into movement of the wedge 115 in a direction generally perpendicular to the plane formed by the handgun 20.

The wedge 115 is, for example, a rigid blade fixed at an upper extremity to the housing 105. When the first button 120 is released, the free extremity of the wedge 115 is pushed by a mechanism so as to enter into the trigger guard of the handgun 20 and be positioned in contact with this trigger guard. In this way, when no pressure is exerted on the first button 120, it is impossible to remove the handgun 20 from the holster 10. When pressure is exerted on the first button 120, the free extremity of the wedge 115 is drawn out of the trigger guard of the handgun 20. This holding wedge 115 is manufactured so as to adopt the shape of a trigger guard of a model of handgun 20 specifically associated to the holster 10. In this way, the holding wedge 115 also serves to keep the handgun 20 in position in the holster.

The wedge 115 is pushed mechanically towards the retention position by means of a spring, which pushes the motor means 150 so that the wedge 115 protrudes in the housing 105.

In this way, when the handgun 20 is positioned in the holster 10, the trigger guard of the handgun 20 gradually slides over the wedge 115 pushing the wedge 115 in the released position until the trigger guard of the handgun 20 passes beyond the extremity of the wedge 115. When the trigger guard has passed beyond the extremity of the wedge 115, because of the wedge 115 being pushed mechanically towards the retention position, the wedge 115 is positioned inside the trigger guard of the gun 20 so as to form a stop preventing the extraction of the gun 20.

The shapes of the holding wedge 115 and the housing 105 are configured to respectively adopt the shape of a predefined handgun 20 and the shape of the inside of the trigger guard of said handgun 20. In this way, the handgun 20 is maintained, as well as being held, in the holster 10 independent from the opening of the flap 125.

In some variants, the wedge 115 has a flexible portion with a shape memory, retracted by the activation of the push-button 120. This flexible portion makes it possible to adapt the wedge to different shapes of trigger guards of models of handgun 20.

Where the first push-button 120 and the second push-button 120 are one and the same, the motor means 150 of the wedge 115 is connected to the motor means 170 of the rod 160. In this configuration, pressing on the combined push-buttons 120 causes a withdrawal of both the wedge 115 and the rod 160. This simultaneous withdrawal is realized, for example, by a rod linking the blade forming the motor means 170 to the motor means 150 of the wedge 115. This rod, connected to the free extremity of the wedge 115, draws the wedge 115 towards the outside of the housing 105 when the blade is pushed towards the bottom of the housing 105.

The first and/or second push-button 120 comprises a means 140 for adjusting the height of each said push-button 120. This means for adjusting the height corresponds, for example, to a set of tapped holes in said push-button 120 and in each structural element connecting said push-button 120 to a motor means, 150 or 170. These tapped holes allow said push-button 120 to be screwed at one of a plurality of possible hole heights.

In some variants, the holster 10 comprises a third push-button 145, positioned in the housing 105, activating this third push-button 145 leads to the flap 125 being placed in the closed position.

The holster 10 comprises a means for fastening to a belt of a user. This fastening means is, for example, a mechanism similar to a belt buckle. This mechanism comprises two openings for the passage of the belt, and a clip allowing the entire holster 10 to be removed from the belt.

In some variants, the holster 10 comprises a means, not shown, for locking the position of the wedge 115 in the retention position. This locking means is, for example, a rod in the form of a nail traversing the holster 10 to block the sliding of the motor means 175. This blocking is realized, for example, by inserting the rod into an aperture of the motor means 175. The position of the rod is locked by a key complementing a shape of the nail head.

In other variants, the holster 10 comprises a means 180 for locking the retention of the handgun 20 in the housing 105. This locking means 180 is, for example, a rod in the form of a nail passing through both the holster 10 and the inside of the trigger guard of the handgun 20. This rod is removed by using a means, not shown, for unlocking the holster 10, such as a key or a code, for example.

FIG. 2 shows, in particular, a representation of the handgun 20 in the holster 20 when the flap 125 is closed.

FIG. 3 shows, in particular, a particular view of the motor means, 150 and 170, allowing a press on a first push-button 120 and second push-button 120, which are one and the same, to be converted into retraction of both the wedge 115 and the rod 160.

The invention claimed is:

1. Holster for a handgun having a trigger guard and a barrel, that comprises:

a housing for the handgun comprising a top opening for the passage of at least part of the handgun;

a wedge for holding the handgun in the housing;

a first push-button for positioning the wedge:

in a position referred to as the "retention" position, in which the wedge is positioned in the trigger guard so as to prevent the handgun from being extracted from the housing when the first button is released; or in a position referred to as the "released" position, in which the wedge is positioned out of the trigger guard when the first button is engaged;

a flap, mounted to rotate about a hinge positioned along a long side of a transverse opening of the housing, said transverse opening being positioned facing the barrel and forming:

in what is referred to as a "closed" position, a face that covers the transverse opening and in what is referred to as an "open" position, a guide for the sliding of the handgun toward the transverse opening; and the first push-button opening the flap when the first button is engaged.

2. Holster according to claim 1, that further comprises an adjuster for adjusting the height of at least one push-button.

3. Holster according to claim 1, that further comprises another push-button, positioned in the housing, wherein activating this push-button places the flap in the closed position.

4. Holster according to claim 1, that further comprises a motor that transforms a longitudinal press on the first push-button into movement of the wedge in a direction generally perpendicular to the plane formed by the handgun.

5. Holster according to claim 1, that further comprises:

a groove, along the hinge, for a rod connected to the housing;

a means for longitudinally moving the rod when the first push-button is engaged; and a motor for causing the hinge to rotate when the rod is disengaged from the groove, this rotation corresponding to the opening of the flap connected to the hinge.

6. Holster according to claim 5, that further comprises a motor to transform a longitudinal press on the first push-button into movement of the rod in a direction generally parallel to the plane formed by the handgun.

7. Holster according to claim 1, that further comprises a lock that locks the retention of the handgun in the housing.

8. Holster according to claim 1, wherein shapes of the holding wedge and the housing correspond to shapes of a predefined handgun and a shape of the inside of the trigger guard of said handgun.

* * * * *